US005686701A

United States Patent [19]

Fukushima et al.

[11] Patent Number: 5,686,701

[45] Date of Patent: Nov. 11, 1997

[54] CONNECTOR LID OPENING-CLOSING CONSTRUCTION

[75] Inventors: Hirotaka Fukushima; Toshiaki Hasegawa; Shigemi Hashizawa, all of Shizuoka, Japan

[73] Assignee: Yazaki Corporation, Tokyo, Japan

[21] Appl. No.: 503,933

[22] Filed: Jul. 19, 1995

[30] Foreign Application Priority Data

Jul. 19, 1994 [JP] Japan ..... 6-167227

[51] Int. Cl.[6] ..... H01R 13/52

[52] U.S. Cl. ..... 174/67

[58] Field of Search ..... 174/60, 67; 220/241, 220/242; 70/164; 292/145

[56] References Cited

U.S. PATENT DOCUMENTS

| | | | |
|---|---|---|---|
| 4,058,358 | 11/1977 | Carlisle | 339/44 |
| 4,484,021 | 11/1984 | Schaefer et al. | 174/53 |
| 5,067,907 | 11/1991 | Shotey | 439/135 |
| 5,193,707 | 3/1993 | Mizumura | 220/326 |
| 5,571,995 | 11/1996 | Pierce | 174/67 |

FOREIGN PATENT DOCUMENTS

| | | | |
|---|---|---|---|
| 60-24539 | 6/1985 | Japan | H01R 13/639 |
| 4124774 | 11/1992 | Japan | H01R 13/52 |

*Primary Examiner*—Kristine L. Kincaid
*Assistant Examiner*—Joseph Waks
*Attorney, Agent, or Firm*—Sughrue,Mion,Zinn,Macpeak & Seas, PLLC

[57] ABSTRACT

Two separate lids are openably provided at two power receiving portions, respectively. A lid fixing unit is provided for sliding movement in a direction of the juxtaposition of the two power receiving portions. The lid fixing unit overlaps both of the two lids to prevent the two lids from being opened when the lid fixing unit is disposed in an intermediate position between the two power receiving portions. The lid fixing unit is movable away from one of the two lids to face the other lid, thereby allowing the opening of the one lid, and the lid fixing unit is movable away from the other lid to face the one lid, thereby allowing the opening of the other lid.

6 Claims, 5 Drawing Sheets

CONNECTOR LID OPENING-CLOSING CONSTRUCTION

BACKGROUND OF THE INVENTION

The present invention relates to a connector lid opening-closing construction having two power receiving portions or feeding portions used respectively for quick charging and slow charging or the like.

An electric car can travel by driving a DC motor through a self-contained power source (battery) mounted on the car. Usually, the self-contained battery is charged by a charger installed at a charging station as in the refueling of a gasoline car. At present, however, the number of such charging stations is much smaller than the number of gas stations for gasoline cars. Therefore, the conventional electric car is provided with a power receiving portion for effecting quick charging (DC 150–400 A) at a charging station and another power receiving portion for effecting the slow charging at home, using a commercial power source (e.g. 240 V).

One such power receiving connector, in which power receiving portions are arranged in a concentrated manner to save an installation space, will be described below with reference to FIGS. 6 to 8. FIG. 6 is a cross-sectional view of the conventional power receiving connector, FIG. 7 is a front-elevational view of the conventional power receiving connector, and FIG. 8 is a front-elevational view of the conventional power receiving connector, with a lid held in its open condition.

This power receiving connector 1 comprises an outer casing 5 having an integral flange 3 for mounting on a car body, and a housing 9 received in a recess 7 in the outer casing 5. The housing 9 has a DC (direct current) power receiving portion 11 of a larger diameter, and an AC (alternating current) power receiving portion 13 of a smaller diameter partially inscribed in the DC power receiving portion 11. The two power receiving portions 11 and 13 are separated from each other by an outer wall 15. Various male terminals 17, 19 and 21 are provided in a projected manner in an internal space surrounded by the outer wall 15.

A first cap (lid) 23 is pivotally mounted on the outer casing 5 for openably closing an opening in the housing 9 over an entire area thereof. The first cap 23 has a through hole 25 which is disposed to coincide with the AC power receiving portion 13 in the closed position of the first cap 23, and a second cap (lid) 27 is pivotally mounted on an outer surface of the first cap 23 for closing the through hole 25. The first cap 23 is opened and closed in a lateral or horizontal direction, and the second cap 27 is opened and closed in a vertical direction.

In the conventional power receiving connector 1 of the above construction, when the quick charging is to be effected at a charging station, the first cap 23 is opened, and a DC feeder connector is connected to the DC power receiving portion 11, thus effecting the charging. On the other hand, when the slow charging is to be effected at home, the second cap 27 is opened with the first cap 23 kept closed (see FIG. 6), and an AC feeder connector 29 is inserted into the AC power receiving portion 13 through the exposed through hole 25, thus effecting the charging.

In the conventional power receiving connector 1, since the plurality of power receiving portions are combined together into a single construction, the connector can be of a small size, and installation space in the car body can be reduced.

In the conventional power receiving connector 1, however, the through hole 25 is formed in the outer surface of the first cap 23, and the second cap 27 for closing this through hole 25 is pivotally mounted on the outer surface of the first cap 23. With this construction, only the AC power receiving portion 13 can be opened, or both of the DC power receiving portion 11 and the AC power receiving portion 13 can be opened at the same time. Therefore, if the first cap 23 is inadvertently opened when the AC power receiving portion 13 is to be used, the AC power receiving portion 13 is exposed, and the intended charging can be carried out. However, the DC power receiving portion 11, in which the associated feeder connector is not fitted, is also exposed in the vicinity of the AC feeder connector 29 during the charging operation, so there is a fear that an accident may occur.

SUMMARY OF THE INVENTION

The present invention has been made in view of the above problems, and an object of the invention is to provide a connector lid opening-closing construction in which two caps can not be opened at the same time, so that contact with those terminals not to be used is prevented during a charging operation, and also a waterproof effect is enhanced.

The above object has been achieved by a lid opening-closing construction of the invention for a connector in which two power receiving portions or feeding portions are closely juxtaposed to each other; characterized in that two separate lids are openably provided at the two power receiving portions or feeding portions, respectively; lid fixing means is provided for sliding movement in a direction of juxtaposition of the two power receiving portions or feeding portions; the lid fixing means overlaps both of the two lids to prevent the two lids from being opened when the lid fixing means is disposed in an intermediate position between the two power receiving portions or feeding portions; the lid fixing means is movable out of one of the two lids to face the other lid, thereby allowing the opening of the one lid; and the lid fixing means is movable out of the other lid to face the one lid, thereby allowing the opening of the other lid.

In a normal condition in which both of the two lids are closed, the lid fixing means is held in the intermediate position to hold both of the two lids against opening movement.

When one of the two lids is to be opened, the lid fixing means is moved out of the one lid to face the other lid, thereby allowing the opening of the one lid. In this condition, the lid fixing means is prevented from moving by the one lid disposed in its projected position.

When the other lid is to be opened, the lid fixing means is moved to face the one lid after the one lid is closed, and then the other lid is allowed to be opened in a similar manner as described above, and in this condition the lid fixing means is prevented from moving by the other lid disposed in its projected position.

DETAILED DESCRIPTION OF THE INVENTION

Preferred embodiments of a connector lid opening-closing construction of the present invention will now be described with reference to the drawings.

Figure 1:
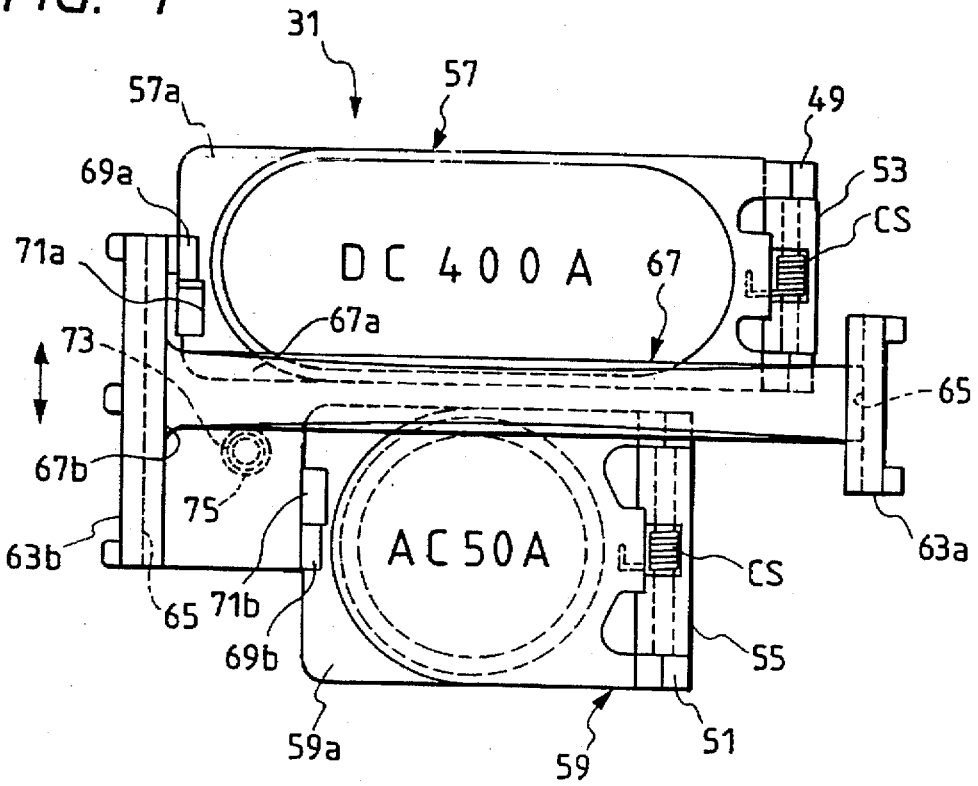
FIG. 1 is a front-elevational view showing a power receiving connector lid opening-closing construction of the present invention.
Figure 2:
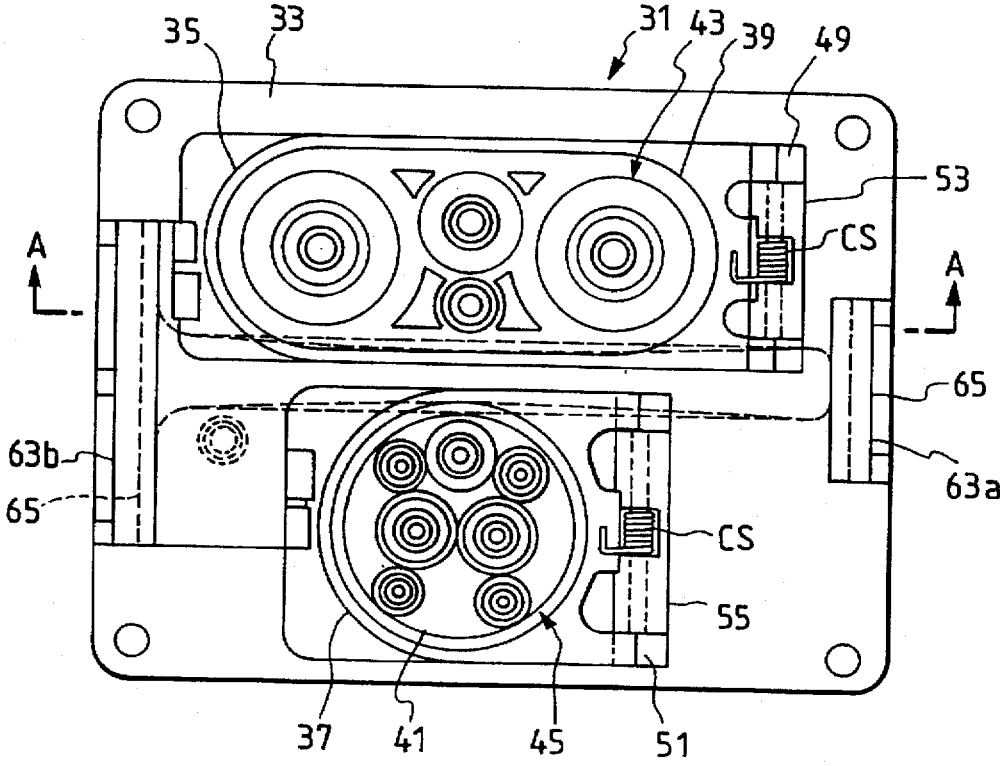
FIG. 2 is a front-elevational view of the power receiving connector lid opening-closing construction of the invention, as viewed through the lid structure.
Figure 3:
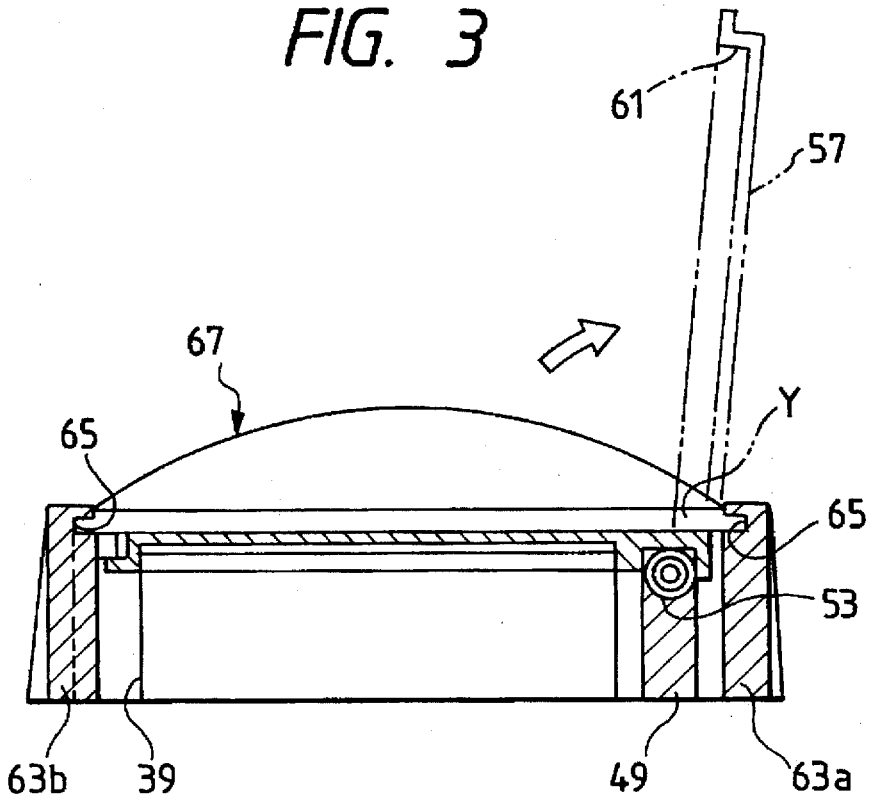
FIG. 3 is a cross-sectional view taken along the line A—A of FIG. 2.

FIG. 1 is a front-elevational view showing a power receiving connector lid opening-closing construction of the invention, FIG. 2 is a front-elevational view of the power receiving connector lid opening-closing construction of the invention, as viewed through the lid structure, and FIG. 3 is a cross-sectional view taken along the line A—A of FIG. 2.

As shown in FIG. 2, a tubular DC outer casing 35 and a tubular AC outer casing 37 (each of which has an outer open end) are provided at an outer surface of a flange 33 (which is adapted to be mounted on a car body) of a power receiving connector 31, and are vertically closely juxtaposed to each other, outer ends of the two casings 35 and 37 being disposed generally in a common plane. A DC housing 39 for quick charging (e.g. DC 400 A) is received in the DC outer casing 35, and an AC housing 41 for slow charging (e.g. AC 50 A) is received in the AC outer casing 37. A DC power receiving portion 43 of the DC housing 39 is exposed in the outer open end of the DC outer casing 35, and an AC power receiving portion 45 of the AC housing 41 is exposed in the outer open end of the AC outer casing 37.

A support plate 49 is mounted on that portion of the flange 33 disposed adjacent to one side of the end of the outer casing 35, and projects generally into a plane in which the outer end of the outer casing 35 lies. A support plate 51 is mounted on that portion of the flange 33 disposed adjacent to one side of the end of the outer casing 37, and projects generally into a plane in which the outer end of the outer casing 37 lies. A DC cap (lid) 57 is openably mounted on an outer end of the support plate 49 through a hinge 53, and an AC cap (lid) 59 is openably mounted on an outer end of the support plate 51 through a hinge 55. Each of the DC cap 57 and the AC cap 59 closes the associated outer casing, with its recessed surface 61 fitted on the outer end of the associated outer casing. A packing (not shown) is provided at an peripheral portion of the recessed surface 61 so as to ensure a watertight effect when the cap is closed. Each of the DC cap 57 and the AC cap 59 is urged in an opening direction by a resilient member (e.g. a coil spring, a leaf spring or a rubber member) CS mounted on the hinge 53 and 55. A flange **57*a*, 59*a* is formed integrally on a distal end of each of the DC cap 57 and the AC cap 59 remote from the hinge 53, 55, and the two flanges 57*a* and 59*a*** are disposed in a common plane when the two caps are in their respective closed positions.

A plate-like rail **63*a* is formed on one end portion of the flange 33 spaced outwardly from the support plates 49 and 51, and are disposed parallel to these plates 49 and 51. A plate-like rail 63*b* is formed on the other end portion of the flange 33 in opposed relation to the rail 63*a*, so that the outer casings 35 and 37 are disposed between the two rails 63*a* and 63*b*. U-shaped grooves 65 are formed respectively in opposed surfaces of the two rails 63*a* and 63*b* at the outer end portions thereof, and extend in a direction of juxtaposition of the DC and AC power receiving portions 43 and 45**.

Opposite ends of a cap lock (lid fixing means) 67 are fitted respectively in the U-shaped grooves 65 in the rails **63*a* and 63*b*, so that the cap lock 67 is slidable in the direction of juxtaposition of the DC and AC power receiving portions 43 and 45. The cap lock 67 includes an elongate arm portion (base portion) 67*a* extending perpendicular to the rails 63*a* and 63*b* (laterial direction), and a sliding plate portion 67*b* formed at one end thereof, the sliding plate portion 67*b* extending perpendicular to the arm portion 67*a*. The cap lock 67 is parallel moved along the rails 63*a* and 63*b* so that the cap lock 67 can face the DC cap 57 and the AC cap 59. When the cap lock 67 is disposed between the DC cap 57 and the AC cap 59, the cap lock 67 overlaps the outer surfaces of both of the two caps 57 and 59** at the same time.

The sliding plate portion **67*b* of the cap lock 67 has two projections 69*a* and 69*b* between which the arm portion 67*a* is disposed, and the two projections 69*a* and 69*b* project respectively toward the flanges 57*a* and 59*a* to overlap the outer surfaces of these flanges 57*a* and 59*a*, respectively. Therefore, when the projections 69*a* and 69*b* overlap the flanges 57*a* and 59*a*, respectively, the DC cap 57 and the AC cap 59** are prevented from being opened.

The flange **57*a* of the DC cap 57 has a recess 71*a* for loosely receiving the projection 69*a* therein. When the cap lock 67 is moved to face the AC cap 59, the projection 69*a* coincides with the recess 71*a*. The flange 59*a* of the AC cap 59 has a recess 71*b* for loosely receiving the projection 69*b* therein. When the cap lock 67 is moved to face the DC cap 57, the projection 69*b* coincides with the recess 71*b***.

A ball lock (limiting means) 73 is provided in opposed relation to the back side of the sliding plate portion **67*b*. Although not shown in the drawings, this ball lock 73 has a ball urged against the sliding plate portion 67*b* by a spring. When the cap lock 67 is disposed between the DC cap 57 and the AC cap 59, that is, disposed in an intermediate position, the ball lock 73 is disposed to coincide with a recess 75 formed in the back surface of the sliding plate portion 67*b*. Namely, the ball lock 73 prevents an easy movement of the cap lock 67 out of the intermediate position, and also produces a suitable degree of resistance to the movement of the cap lock 67**.

The power receiving connector lid opening-closing construction comprises, as main parts or portions, the DC outer casing 35, the AC outer casing 37, the DC cap 57, the AC cap 59, the flanges **57*a* and 59*a*, the rails 63*a* and 63*b*, the cap lock 67, the projections 69*a* and 69*b*, the recesses 71*a* and 71*b*, and the ball lock 73**.

Figure 4:
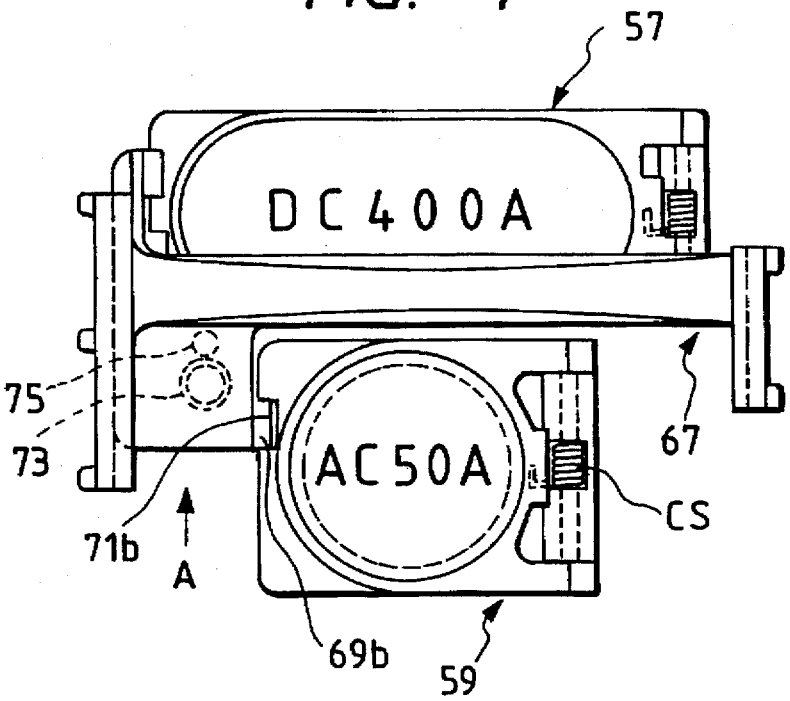
FIG. 4 is a view showing a condition in which an AC cap is to be opened.
Figure 5:
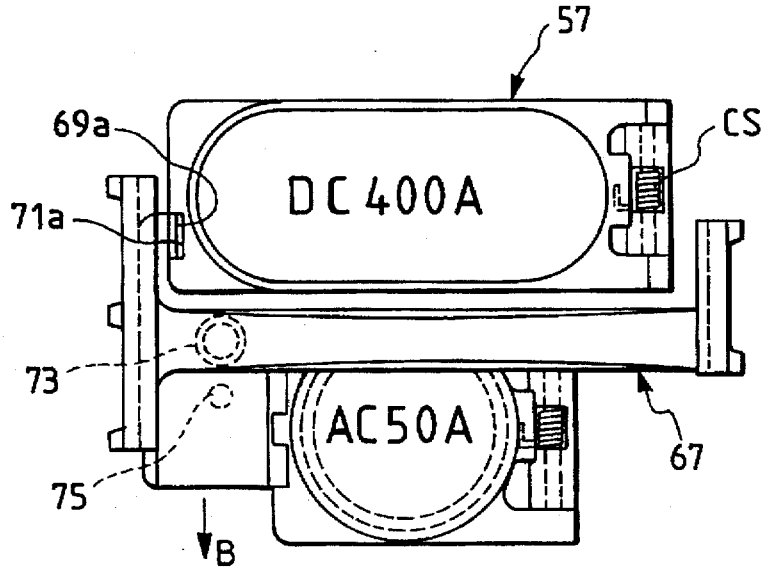
FIG. 5 is a view showing a condition in which a DC cap is to be opened.
Figure 6:
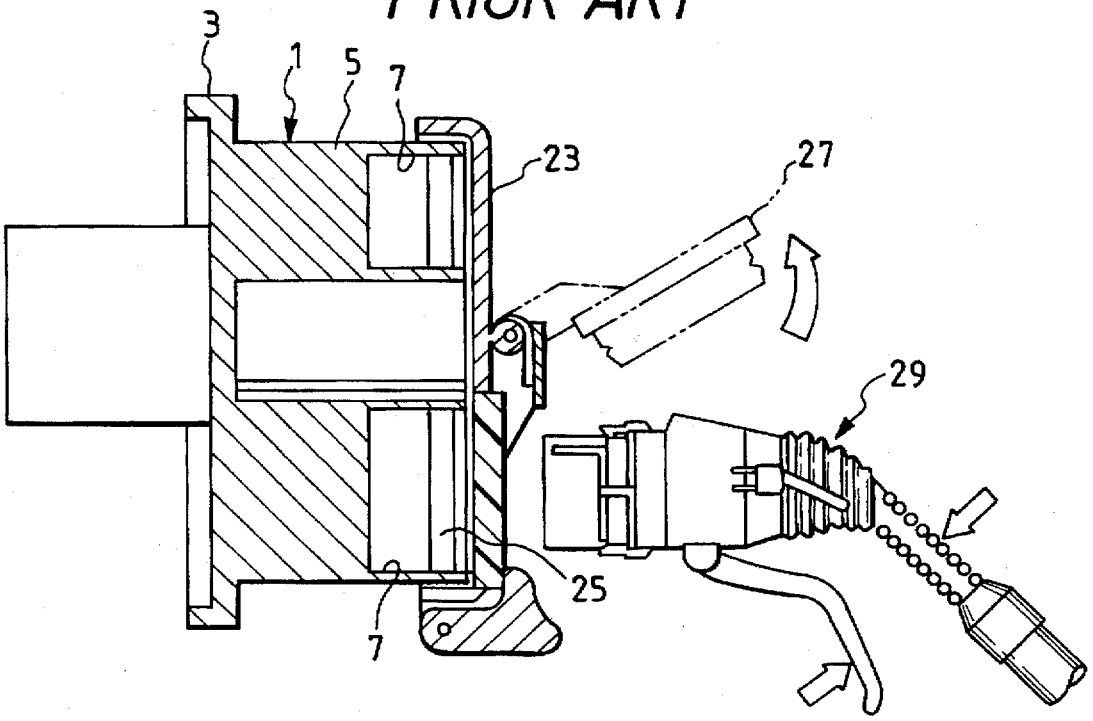
FIG. 6 PRIOR ART
FIG. 6 is a cross-sectional view of a conventional power receiving connector.
Figure 7:
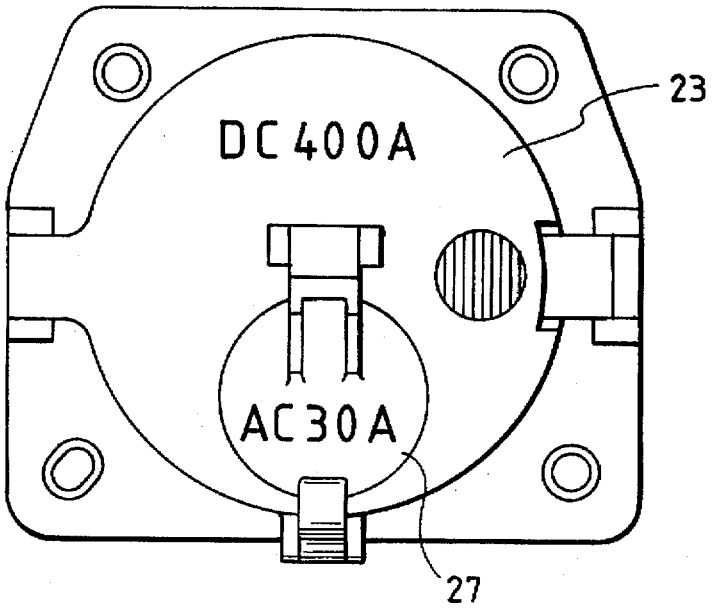
FIG. 7 PRIOR ART
FIG. 7 is a front-elevational view of the conventional power receiving connector.
Figure 8:
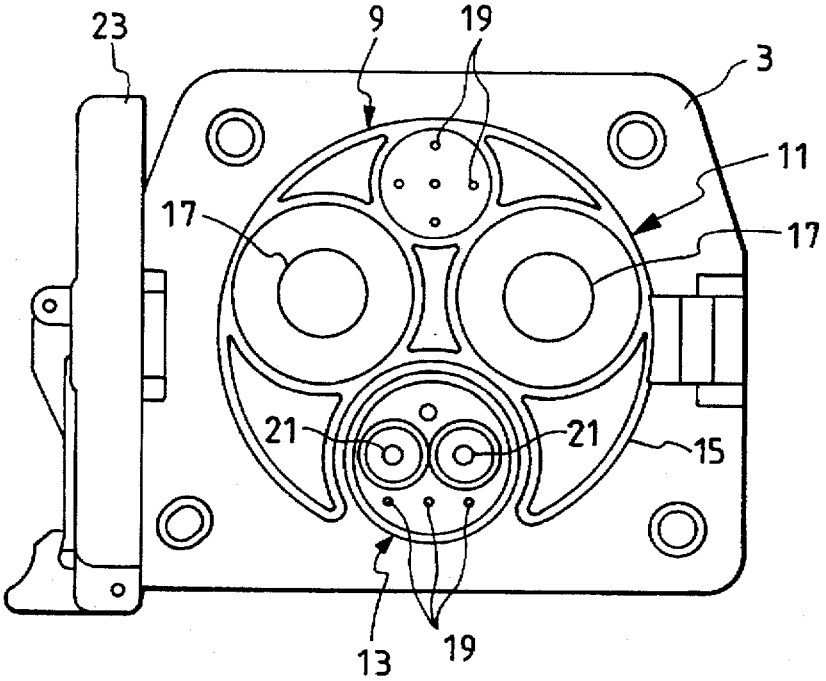
FIG. 8 PRIOR ART
FIG. 8 is a front-elevational view of the conventional power receiving connector, with a lid held in its open condition.

FIG. 4 is a view showing a condition in which the AC cap is to be opened, and FIG. 5 is a view showing a condition in which the DC cap is to be opened.

In the above power receiving connector lid opening-closing construction, the DC cap 57 and the AC cap 59 are normally closed as shown in FIG. 1, and in this condition, the cap lock 67 is retained in the intermediate position by the ball lock 73 to hold both of the DC cap 57 and the AC cap 59 against opening.

When alternating current is to be used, the cap lock 67 is moved upward in a direction indicated by arrow A (FIG. 4). When the projection **69*b* is made coincident with the recess 71*b*, the AC cap 59 is opened by the coil spring CS. In this condition, even if trying to move the cap lock 67 downward, the cap lock 67 is held against the side Y of the cap (see FIG. 3) since the AC cap 59 is disposed in its projected position, so that the cap lock 67** is prevented from movement.

When direct current is to be used, the opened AC cap 59 is closed, and then the cap lock 67 is moved downward in a direction indicated by arrow B (FIG. 5). When the projection 69*a* is made coincident with the recess 71*a*, the DC cap 57 is opened by the coil spring CS. In this condition, even if trying to move the cap lock 67 upward, the cap lock 67 is prevented by the DC cap 57 from movement. Thus, even with any procedure, the DC cap 57 and the AC cap 59 will not be opened at the same time.

Figure 9:
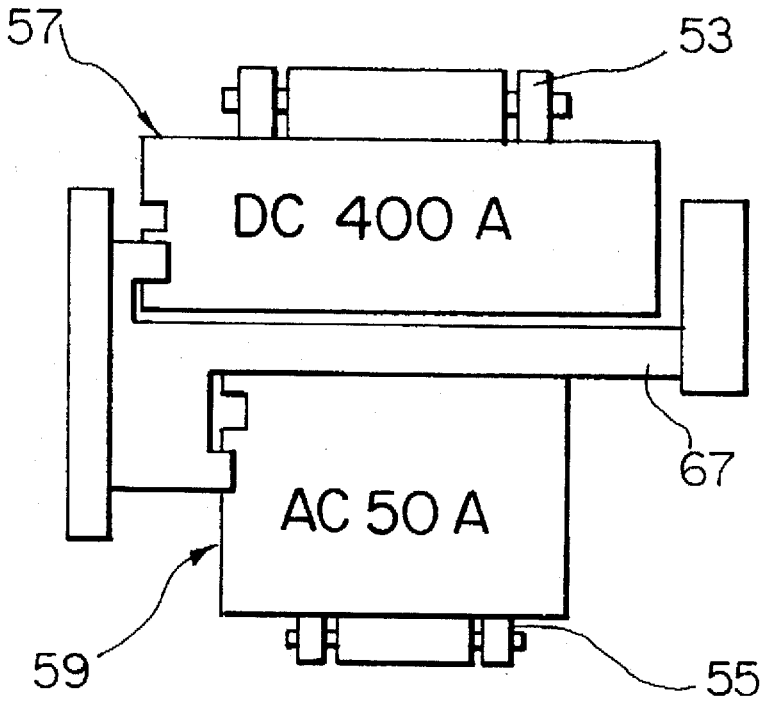
FIG. 9 is a view showing a condition in which both a DC cap and an AC cap can be opened.

In the above embodiment, although the DC cap 57 and the AC cap 59 are supported respectively at one end of the DC outer casing 35 and the AC outer casing 37 through the respective hinges 53 and 55, the hinge 53 pivotally supporting the DC cap 57 can be provided at the upper side of the DC cap 57 whereas the hinge 55 pivotally supporting the AC cap 59 can be provided at the lower side of the AC cap 59 as shown in FIG. 9. In this case, although the cap lock 67 selectively limits the opening of the caps as described above, the cap lock 67 can be moved toward the opened cap when the cap is opened. Therefore, this arrangement is suitable in the case where the two caps are to be prevented from being opened at the same time in the normal operation, and also the two caps can be opened at the same time.

Although the above embodiment is directed to the power receiving connector lid opening-closing construction, the invention is not limited to such a power receiving connector, and can be applied to a lid opening-closing construction for a feeding connector.

As described in detail, in the connector lid opening-closing construction of the present invention, the two separate lids are provided at the two power receiving portions or feeding portions, and the lid fixing means for selectively preventing the opening of the two lids is provided for sliding movement in the direction of juxtaposition of the two power receiving portions or feeding portions. Therefore, only one of the two lids can be opened, and both of the two lids can not be opened at the same time. As a result, the contact with that power receiving portion or feeding portion not to be used is positively prevented during a charging operation, and also a waterproof effect can be enhanced.

What is claimed is:

1. A lid opening-closing construction for a connector in which two power receiving portions or feeding portions are closely juxtaposed to each other, comprising:

a first openable lid for covering one of said two power receiving portions or feeding portions;

a second openable lid for covering the other of said two power receiving portions or feeding portions; and lid fixing means provided for sliding movement in a direction of the juxtaposition of said two power receiving portions or feeding portions, said lid fixing means overlapping both of said first and second lids to prevent said first and second lids from being opened when said lid fixing means is disposed in an intermediate position between said two power receiving portions or feeding portions, said lid fixing means being movable away from said first lid to face said second lid, thereby allowing said first lid to open, and said lid fixing means being movable away from said second lid to face said first lid, thereby allowing said second lid to open.

2. A connector lid opening-closing construction according to claim 1, further comprising:

a first flange formed integrally with and projecting from an outer peripheral edge of said first lid;

a second flange formed integrally with and projecting from an outer peripheral edge of said second lid;

a first projection provided on said lid fixing means to abut against said first flange to prevent said first lid from opening;

a second projection provided on said lid fixing means to abut against said second flange to prevent said second lid from opening;

a first recess formed in said first flange; and a second recess formed in said second flange;

wherein when said lid fixing means moves to face said second lid, said first projection is made coincident with said first recess in said first flange so that said first lid is allowed to open; and when said lid fixing means moves to face said first lid, said second projection is made coincident with said second recess in said second lid so that said second lid is allowed to open.

3. A connector lid opening-closing construction according to claim 1, further comprising:

a first hinge portion for said first lid;

a second hinge portion for said second lid;

a first resilient member mounted on said first hinge portion to urge said first lid in an opening direction; and a second resilient member mounted on said second hinge portion to urge said second lid in an opening direction.

4. A connector lid opening-closing construction according to claim 1, further comprising limiting means for preventing an easy movement of said lid fixing means out of said intermediate position.

5. A connector lid opening-closing construction according to claim 3, wherein said first and second hinge portions are arranged parallel to the direction of the juxtaposition of said two power receiving portions or feeding portions so that said first and second lids can not be opened at the same time.

6. A connector lid opening-closing construction according to claim 3, wherein said first and second hinge portions are arranged vertically to the direction of the juxtaposition of said two power receiving portions or feeding portions so that said first and second lids can open at the same time.

* * * * *